US005681066A

United States Patent [19]

Anderson

[11] Patent Number: 5,681,066

[45] Date of Patent: Oct. 28, 1997

[54] TWO-POINT SELF-CLOSING LATCH

[75] Inventor: John P. Anderson, Norco, Calif.

[73] Assignee: Hartwell Corporation, Placentia, Calif.

[21] Appl. No.: 532,284

[22] Filed: Sep. 22, 1995

[51] Int. Cl.[6] ..... E05G 1/06

[52] U.S. Cl. ..... 292/33; 292/35

[58] Field of Search ..... 292/33, 35, 40, 292/41, 42, 169, DIG. 63

[56] References Cited

U.S. PATENT DOCUMENTS

| | | | |
|---|---|---|---|
| 630,414 | 8/1899 | Schwartz | 292/42 |
| 1,126,223 | 1/1915 | Johnson | 292/40 |
| 1,671,249 | 5/1928 | Lieberman | 70/118 |
| 1,892,743 | 1/1933 | Wenger | 292/42 |
| 2,825,219 | 3/1958 | Marzillier | 70/488 |
| 2,866,574 | 12/1958 | Roumeliotis | 220/326 |
| 3,135,105 | 6/1964 | Brody | 70/71 |
| 3,455,591 | 7/1969 | Powers | 292/335 |
| 4,892,338 | 1/1990 | Weinerman et al. | 292/35 |

*Primary Examiner*—Steven N. Meyers
*Assistant Examiner*—Gary Estremsky
*Attorney, Agent, or Firm*—Pretty, Schroeder & Poplawski

[57] ABSTRACT

A two-point latch for a door, and having first and second bolts, a latch body with a housing and a cap defining a slide path within the body for the bolts, first and second handles mounted in the latch body for sliding along a handle path parallel to the slide path, and a spring carried in the handles for urging the handles apart. First and second bolt actuators are positioned in the latch body between the handles and the bolts, with the first handle and actuator interengaging for connecting the first actuator to the first handle, and with the second handle and actuator interengaging for connecting the second actuator to the second handle. The first actuator and bolt interengage for drawing the first bolt inward by the first handle, and the second actuator and bolt interengage for drawing the second bolt inward by the second handle, and another spring is carried in the latch body for urging the bolts outward.

7 Claims, 3 Drawing Sheets

TWO-POINT SELF-CLOSING LATCH

BACKGROUND OF THE INVENTION

This invention relates to manually operated latches for doors and the like, and in particular to a new and improved two-point latch especially suited for tall and/or flexible doors.

A two-point latch provides a bolt or other latching member at each end of the door, such as at the top and bottom of a door, with each bolt engaging a striker.

In prior art two-point latches currently on the market, the bolts are directly connected to the handles, and special construction strikers are required for self-closing.

It is an object of the present invention to provide a new and improved two-point latch with the bolt action separate from the handle action so that springs of different strengths can be utilized for the handle action and for the bolt action. Another object of the invention is to provide such a two-point latch which is self-closing without requiring any special striker construction. Also, it is an object to provide such a two-point latch where movement of the bolt does not cause the handles to move.

Other objects, advantages, features and results will more fully appear in the course of the following description.

SUMMARY OF THE INVENTION

The presently preferred embodiment of the two-point latch of the invention includes first and second bolts, a latch body with a housing and a cap and having guide means defining a slide path within the body for the bolts, and first and second handles mounted in the latch body for sliding along a handle path parallel to the slide path. A spring means is carried in the handles for urging the handles apart, and first and second bolt actuators are positioned in the latch body between the handles and bolts, with first interengaging means for connecting the first actuator to the first handle, and second interengaging means for connecting the second actuator to the second handle. Third interengaging means provide for drawing the first bolt inward by the first handle, and fourth interengaging means provide for drawing the second bolt inward by the second handle, with second spring means carried in the latch body for urging the bolts outward.

DESCRIPTION OF THE PREFERRED EMBODIMENT

Figure 1:
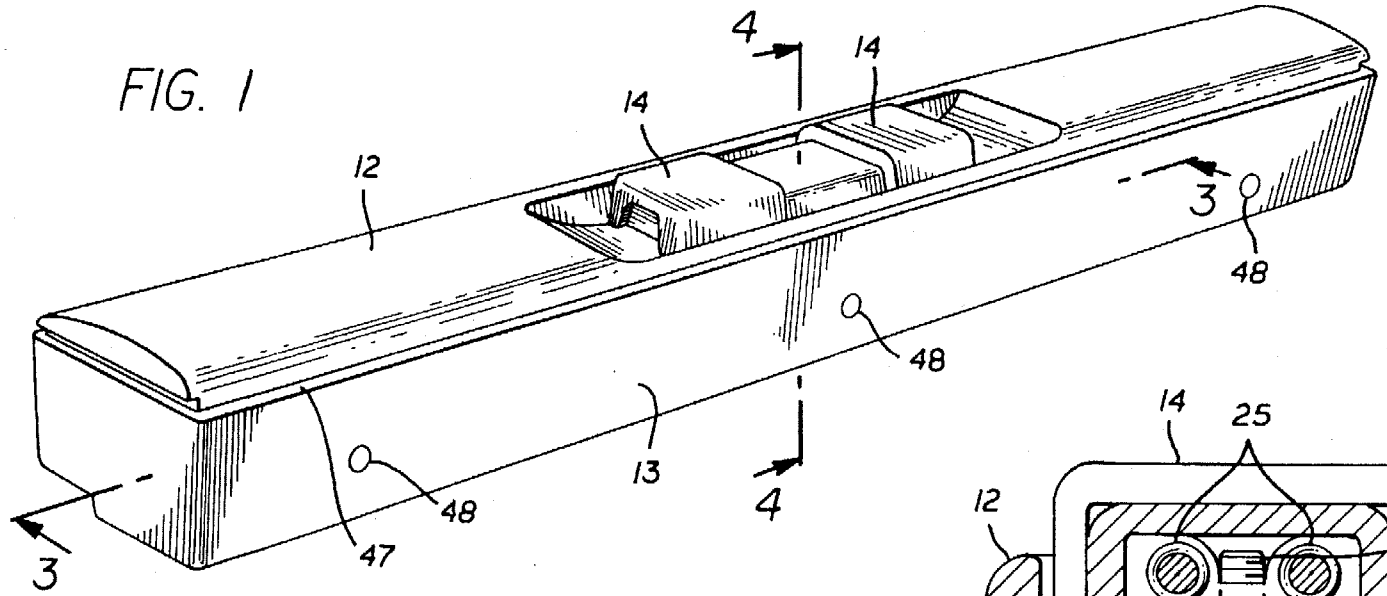
FIG. 1 is a perspective view of a latch incorporating the presently preferred embodiment of the invention.
Figure 4:
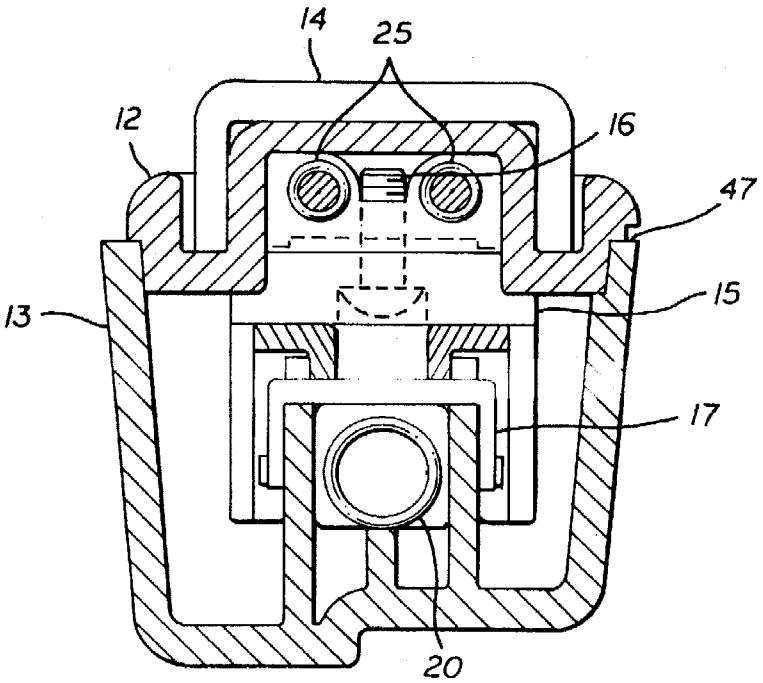
FIG. 4 is an enlarged sectional view taken along the line 4—4 of FIG. 1.
Figure 2:
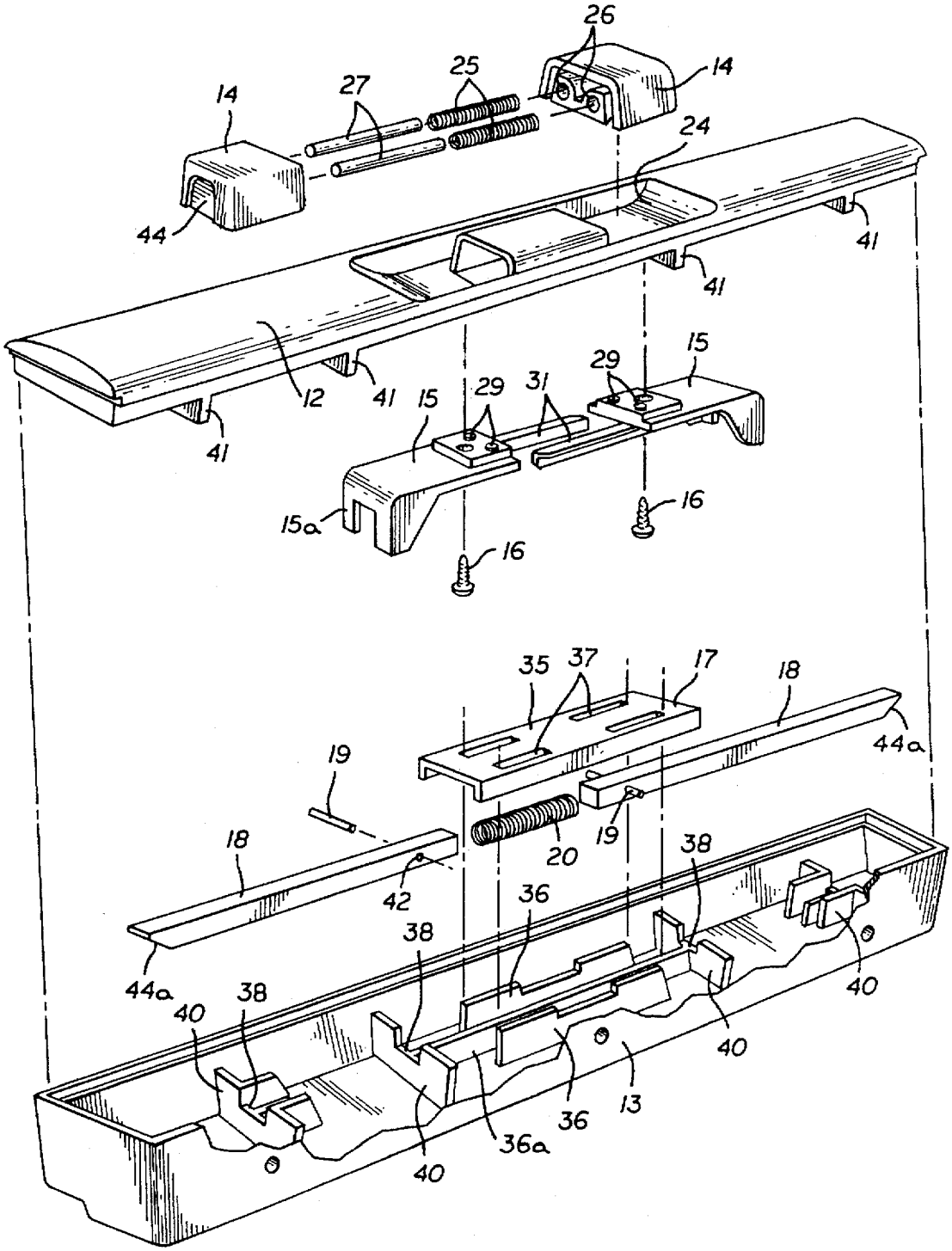
FIG. 2 is an exploded view of the latch of FIG. 1.

The latch described and illustrated herein is sometimes called a two-point latch and is generally used on long doors that require latch points at both ends of the door in order to keep the door closed against gasket pressure, vibrations, or internal loads generated from shifting cargo. Large doors tend to be more flexible than short doors and do not close or seal well at the ends when latched at one single point in the middle of the door.

The latch of the invention can be used to latch a single door or double doors. In a double door installation, the latch is attached to one door and prevents the second door from opening by pushing on the gasket lip or other portion of the second door. The latch holds both doors closed when the two bolts of the latch are engaged with strikers located at the top and bottom of the cabinet. In a single door installation, the latch is attached to the door and pushes on the door jamb.

The latch is made up of a housing 13 and a cap 12. All the other components are assembled into these two components. The cap 12 fits on to the housing 13 at a longitudinal seam 47 along each side and the ends. The intention is to fasten the cap to the housing with an adhesive that will be applied to the seam, but there are other methods that could also be used, including screws or snap fits. The latch typically is attached to the door by screws or other forms of fasteners through openings 48 in the housing 13.

The latch is symmetrical about the mid-point, and components located on one end are identical to components on the other end. Two handles 14 are positioned in the finger well 24 of the cap 12 and slide on the bottom surface of the well when operated.

Each handle 14 has a finger recess 44 to provide a better grip. Springs 25 are positioned in holes 26 in each handle causing the handles to return to their normal outboard position when they are released after being squeezed together to retract the bolts 18. Mandrels 27 are positioned inside the springs to prevent the springs from buckling and keep them aligned with the holes 26. The handles 14 are connected to corresponding actuators 15 by screws 16, but could be attached with other methods such as a snap fit or adhesives, if desired. The upper surface of the actuator seats against the bottom surface of the handle 14. Short posts 29 on the actuators 15 fit into locating holes in the handles 14.

Each actuator 15 has a tang 31 that projects from the inboard end of the actuator. The purpose of these tangs is to stabilize the movement of the actuators when they are moved via the handles 14. When the latch is assembled, the top surface of the tang 31 slides against the bottom surface of the opposite actuator. The bottom surfaces of the tangs 31 slide over the top surface 35 of a guide or guide plate 17. This prevents the actuator from tilting upward or downward while at the same time holds the guide 17 in place by preventing it from moving upward.

The guide 17 is positioned on two ribs 36 located on the bottom inside surface of the housing 13. Portions of the ribs 36 protrude through openings 37 in the guide 17 and hold it in place. This prevents lateral movement of the guide 37.

Two bolts 18 are positioned in notches 38 in the housing cross ribs 40. These notches 38 in combination with longitudinal ribs 36 and 39 guide the bolts 18 during longitudinal travel. Cross ribs 41 located in the cap 12 are positioned over the notched cross ribs 38 and prevent the bolts 18 from lifting out of the notches 38.

A return spring 20 is positioned between between the inboard ends of the bolts 18 and urge the bolts outward to a latched condition. When the latch is assembled, the spring 20 becomes captivated on four sides by the inboard ends of the bolts 18, the longitudinal ribs 36 and **36*a* in the housing, and guide 17**.

A pin 19 is positioned in a hole 42 in each bolt. These pins seat against the inboard surface 43 of the yoke portion **15*a* of the actuators 15 when the spring 20** urges the bolts in an outboard direction.

The pins 19 act as stops to limit the outward travel of the bolts and are used as a means to connect the actuators 15 to the bolts 18. Inboard movement of the handles produced by squeezing the handles together, causes the actuators to pull on the pins, thus moving the bolts to a retracted position and disconnecting them from the strikers. The outboard ends of the bolts 18 have a ramp area 44*a* that causes the bolts to travel inward when they contact the strikers as the door is being closed. Hence, the latch is self-closing.

Figure 3:
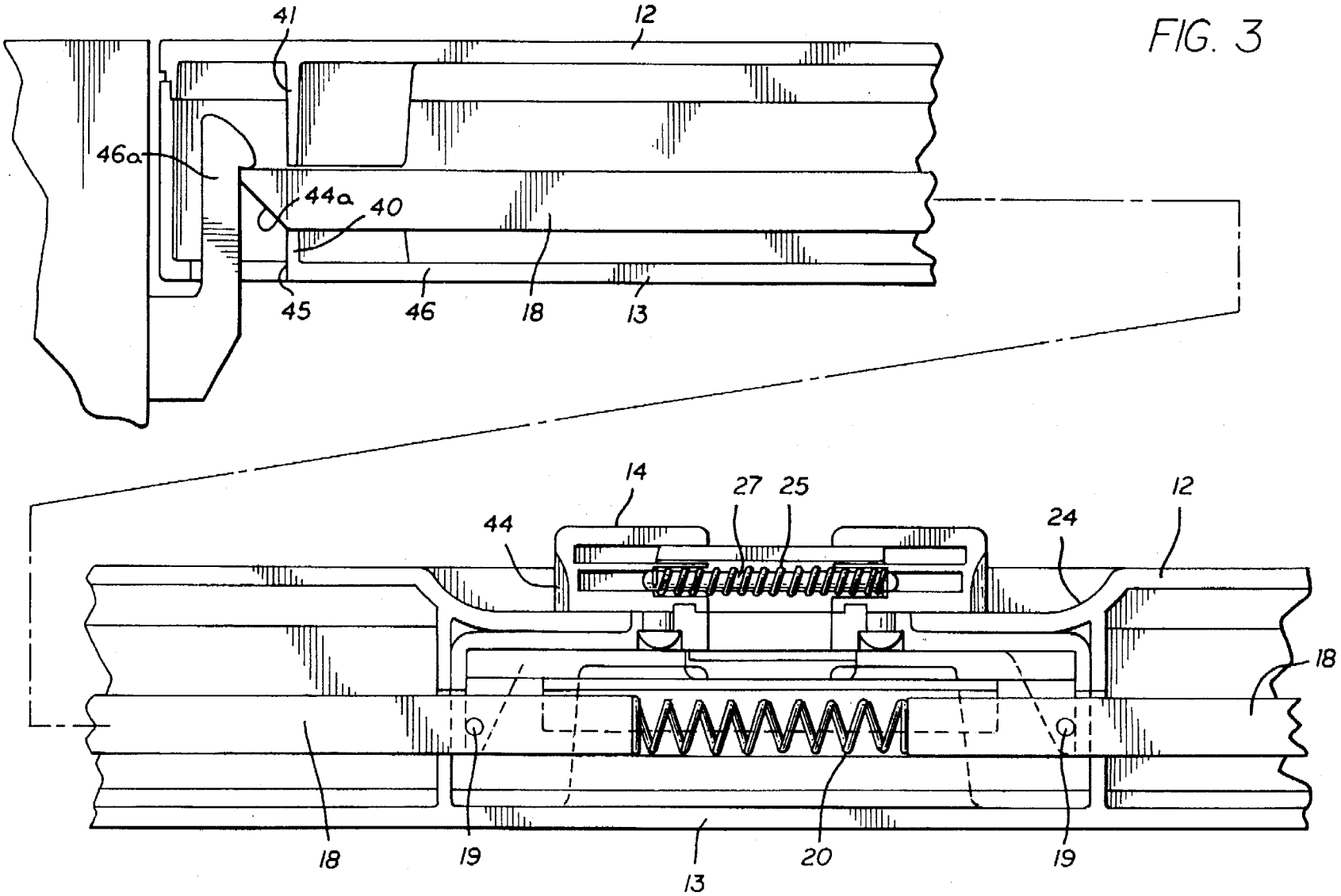
FIG. 3 is an enlarged sectional view taken along the line 3—3 of FIG. 1.

The housing 13 has openings 45 in the bottom surface 46 that are positioned below the end 44*a* of each bolt, providing access to the bolt for a striker 46*a*. With this arrangement, the ends of the bolts are maintained within the latch housing. See FIG. 3.

The finger well 24, actuators 15 and guide 17 typically are in the order of a few inches in length. However, the bolts may be made of any length to fit the door to be latched.

I claim:

1. In a two-point latch for a door, the combination of:

first and second bolts, each of said bolts formed as a single piece with an inner end and an outer end;

a latch body with a housing and a cap, said latch body having bolt guide means positioned within said latch body and defining a slide path within said body for said bolts;

first and second handles mounted in said latch body for sliding along a handle path parallel to said slide path;

first spring means carried in said handles for urging said handles apart;

first and second bolt actuators positioned in said latch body between said handles and said bolts;

said first handle and first actuator having first interengaging means for connecting said first actuator to said first handle;

said second handle and second actuator having second interengaging means for connecting said second actuator to said second handle;

said first actuator and said first bolt having third interengaging means for drawing said first bolt inward by said first handle, said third interengaging means comprising a transverse member on said first bolt and a yoke on said first actuator for engagement with said transverse member to move said first bolt inward toward said second bolt when said first handle is moved inward toward said second handle;

said second actuator and said second bolt having fourth interengaging means for drawing said second bolt inward by said second handle, said fourth interengaging means comprising a transverse member on said second bolt and a yoke on said second actuator for engagement with said transverse member to move said second bolt inward toward said first bolt when said second handle is moved inward toward said first handle;

with said bolts sliding toward each other in said bolt guide means independently of said handles; and a second spring carried in said latch body between and in engagement with said inner ends of said bolts for urging said bolts outward.

2. A latch as defined in claim 1 wherein each of said third and fourth interengaging means includes a depending yoke portion on the actuator and a transverse member on the bolt, with the yoke portion outward of the transverse member, whereby compressing said handles together brings said respective yoke portions and transverse members into engagement to withdraw said bolts against the urging of said second spring means.

3. In a two-point latch for a door, the combination of:

first and second bolts;

a latch body with a housing and a cap, said latch body having guide means defining a slide path within said body for said bolts;

first and second handles mounted in said latch body for sliding along a handle path parallel to said slide path;

first spring means carried in said handles for urging said handles apart;

first and second bolt actuators positioned in said latch body between said handles and said bolts;

said first handle and first actuator having first interengaging means for connecting said first actuator to said first handle;

said second handle and second actuator having second interengaging means for connecting said second actuator to said second handle;

said first actuator and said first bolt having third interengaging means for drawing said first bolt inward by said first handle;

said second actuator and said second bolt having fourth interengaging means for drawing said second bolt inward by said second handle;

second spring means carried in said latch body for urging said bolts outward; and a guide plate positioned in said latch body between said actuators and said guide means, said guide plate having slots for engaging ribs of said guide means to locate said guide plate in said latch body, with said cap and actuators maintaining said guide plate in place on said guide means.

4. A latch as defined in claim 3 wherein each of said actuators includes a tang projecting from the actuator and sliding under the other actuator for maintaining said actuators in alignment.

5. A latch as defined in claim 4 including means defining an opening in a side of said housing adjacent each end of said housing, with the outer end of a bolt within said latch body and accessible through the opening for a latch striker.

6. A latch as defined in claim 1 including means defining an opening in a side of said housing adjacent each end of said housing, with the outer end of a bolt within said latch body and accessible through the opening for a latch striker.

7. In a two-point latch for a door, the combination of:

first and second bolts;

a latch body with a housing and a cap, said latch body having bolt guide means positioned within said latch body and defining a slide path within said body for said bolts, said body having a top, a bottom, opposed sides and opposed ends, first and second handles mounted in said latch body at said top surface of said housing for sliding along a handle path parallel to said slide path;

first spring means carried in said handles for urging said handles apart;

first and second bolt actuators positioned in said latch body between said handles and said bolts;

said first handle and first actuator having first interengaging means for connecting said first actuator to said first handle;

said second handle and second actuator having second interengaging means for connecting said second actuator to said second said first actuator and said first bolt having third interengaging means for drawing said first bolt inward by said first handle;

said second actuator and said second bolt having fourth interengaging means for drawing said second bolt inward by said second handle;

with said bolts sliding toward each other in said bolt guide means independently of said handles;

second spring means carried in said latch body for urging said bolts outward; and means defining openings in said bottom of said body adjacent each end thereof, with the outer ends of said bolts terminating within said latch body and accessible through said openings for latch strikers.

* * * * *